US005427242A

United States Patent [19]

Oliff et al.

[11] Patent Number: 5,427,242

[45] Date of Patent: Jun. 27, 1995

[54] TWO TIER CAN PACKAGE HAVING SECURED DIVIDER PANEL AND METHOD OF FORMING THE SAME

[75] Inventors: James R. Oliff, Austell; James T. Stout, Ellijay, both of Ga.

[73] Assignee: The Mead Corporation, Dayton, Ohio

[21] Appl. No.: 114,813

[22] Filed: Aug. 31, 1993

[51] Int. Cl.[6] ..... B65D 65/00

[52] U.S. Cl. ..... 206/430; 206/160; 206/194; 206/197; 206/821

[58] Field of Search ..... 206/160, 194, 196, 199, 206/197, 161, 427, 430, 593, 821; 229/120.32, 120.38; 53/445, 474

[56] References Cited

U.S. PATENT DOCUMENTS

| | | | |
|---|---|---|---|
| 1,850,714 | 3/1932 | Gaylord | 206/430 |
| 3,050,228 | 8/1962 | Lane . | |
| 3,072,250 | 1/1963 | Houston . | |
| 3,300,041 | 1/1967 | Fuller | 206/192 |
| 3,351,264 | 11/1967 | Bostrom . | |
| 3,565,326 | 2/1971 | Turkovich | 229/120.32 |
| 3,701,466 | 10/1972 | Woodrow et al. . | |
| 3,866,818 | 2/1975 | Smith | 206/427 |
| 3,904,038 | 9/1975 | Forrer | 206/427 |
| 4,194,678 | 3/1980 | Jasper . | |
| 4,421,229 | 12/1983 | Pan et al. . | |
| 4,577,799 | 3/1986 | Oliff | 206/427 |
| 4,789,063 | 12/1988 | Hammett | 206/432 |
| 4,826,016 | 5/1989 | Foster | 229/120.38 |
| 4,848,651 | 7/1989 | Hartness | 229/125.33 |
| 4,896,774 | 1/1990 | Hammett et al. | 206/427 |
| 4,919,265 | 8/1990 | Lems et al. | 206/432 |
| 5,020,668 | 6/1991 | Schuster | 206/427 |
| 5,108,030 | 4/1992 | Schuster et al. | 206/427 |
| 5,197,656 | 3/1993 | Hoell et al. | 206/427 |
| 5,246,113 | 9/1993 | Schuster | 206/430 |

*Primary Examiner*—David T. Fidei
*Attorney, Agent, or Firm*—Tsugihiko Suzuki

[57] ABSTRACT

A package comprises a plurality of beverage cans arranged into a group of at least two vertically-aligned tiers, a carton disposed around the exterior of the group of the cans, and a divider panel disposed between upper and lower adjacent tiers. Each can has a cylindrical side wall defining an axis. The cans in each tier have their axes disposed vertically and parallel to each other. The carton includes top and bottom panels interconnected by a pair of side panels to form a tubular structure, and a pair of end closure structures disposed to close opposite open ends of the tubular structure. The end closure structures are connected to the tubular structure and are disposed substantially adjacent the side walls of the cans of the group along opposite ends of the group. The divider panel is provided with a pair of anchor flaps which are secured to the end closure structures.

14 Claims, 7 Drawing Sheets

TWO TIER CAN PACKAGE HAVING SECURED DIVIDER PANEL AND METHOD OF FORMING THE SAME

BACKGROUND OF THE INVENTION

This invention relates generally to packages of articles such as beverage cans arranged in two or more tiers, and more particularly to such packages having divider panels between tiers of articles. The invention also relates to a method of forming such packages.

U.S. patent application Ser. No. 08/049,787 describes a multiple-tier can package wherein a multiple of beverage cans in two or more tiers are contained in a paperboard carton. According to the application, 24 cans in a package, for example, can be arranged as two tiers of 3×4 arrays in vertical alignment. Such a package has a double-height graphic area on its sides as compared to conventional single-tier can packages.

A multiple-tier can package is not without disadvantages. Due to its relatively great height and its multiple-tier structure, the package is more susceptible to crushing force acting diagonally thereof and thus tends to be skewed when undergoing such force. This tendency is more significant in case of a loose package wherein the carton is substantially larger than its contents. Undebossed divider panels which are commonly used in multiple-tier can packages often yield loose packages. Those undebossed paperboard divider panels placed between tiers of cans can cause "shrinking" of the height of the carton contents and thereby create loose packages. Repeated skewing of a carton can further loosen the carton, weakening it and detracting from its appearance.

Another disadvantage exists in the stacking process for cans, in connection with the above-mentioned divider panels. To form, for instance, a two-tier arrangement of multiple cans, an already arranged upper tier of cans is slidingly moved over an already arranged lower tier of cans after a divider panel is placed on top of the lower tier. In this process, the divider panel is frictionally pushed by the upper tier and may be moved out of alignment with or even off of the lower tier.

What is needed, therefore, is a structurally stable or rigid multiple-tier package having a divider panel(s) and a method of forming such a package that provides a solution to the problem of slidingly moving an upper tier of cans over a lower tier while using a divider panel.

SUMMARY OF THE INVENTION

In meeting the foregoing needs, the present invention provides a package which comprises a plurality of beverage cans arranged into a group of at least two vertically-aligned tiers, a carton disposed around the exterior of the group of the cans, a divider panel disposed between upper and lower adjacent ones of the tiers and in contact with the cans in the Upper and lower adjacent tiers, and anchoring means for securing the divider panel to end closure structures of the carton. Each can has a generally cylindrical side wall defining a cylindrical axis. The cans in each tier have the their axes disposed vertically and parallel to each other. The carton includes top and bottom panels other than the end closure structures. The top and bottom panels are interconnected by a pair of side panels to form a tubular structure, and the opposite open ends of the tubular structure are closed by the end closure structures. The end closure structures are connected to the tubular structure and are disposed substantially adjacent the side walls of the cans of the group along opposite ends of the group.

The package of the invention is structurally stable and rigid in that it is resistant to crushing force acting diagonally of the package and is not easily skewed when undergoing such force. This owes to the fact that the end closure structures are secured to the divider panel which is clamped between the tiers of the cans.

In a preferred embodiment, the anchoring/securing means comprises a pair of anchor flaps joined to the divider panel and adhesively secured to the end closure structures. The anchor flaps may be foldably joined to the opposite end edges of the divider panel which edges are disposed adjacent respectively to the end closure structures of the carton.

Alternatively, the anchoring/securing means comprises an anchoring flap foldably joined to the divider panel, a locking aperture formed in the anchoring flap, and a locking tab struck from the carton so as to be received in the locking aperture.

In the package of the invention, the divider panel may have tearing means for splitting the divider panel into two portions. A preferred embodiment of such means is a tear line formed in the divider panel. Alternatively, the tearing means may be a tear strip defined by a pair of parallel tear lines formed in the divider panel.

According to an alternate definition, the invention may provide a method of forming a package as previously defined. Such a method comprises the steps of arranging a plurality of beverage cans into a group of at least two vertically-aligned tiers including a divider panel interposed between upper and lower adjacent ones of the tiers, loading the group of the cans into a carton through an open end of a tubular structure of the carton, and securing end closure structure of the carton to the divider panel so as to close the open end of the tubular structure.

Other advantages and objects of the present invention will be apparent from the following description, the accompanying drawings, and the appended claims.

DETAILED DESCRIPTION OF THE PREFERRED EMBODIMENT

The present invention is intended primarily for use with aluminum or steel cans of the type used in packaging beverages. A typical example of such a can consists of a so called "single-piece, seamless drawn can body" and a lid with a pull-tab opening feature. More specifically, such a can includes a generally cylindrical side wall and upper and lower opposite ends. The upper end of the can includes a peripheral flange and a top surface which is recessed below flange. The flange at the upper end has a diameter which is greater than the diameter of the lower end. Thus, when stacked, the can lower end will nest within the upper end of the underlying can so that the lower end rests on the top surface or on the inner surface of the flange.

In accordance with the invention, a package is provided wherein a plurality of cans 10 such as described above is loaded into a carton in a multi-tiered arrangement. An example of such a can arrangement can be seen by reference to FIG. 1. As shown therein, two-tiers of six cans each are arranged to provide a package containing twelve cans. Of course, it will be recognized that the invention may be used with any arrangement or number of cans for each tier, and may also be used for can arrangements having greater than two tiers.

In order to eliminate metal-to-metal contact between the tops and bottoms of the stacked cans, a divider panel 30 is placed between the tiers of cans 10, resting upon the top surfaces of the cans in the lower tier, while supporting the can bottoms of the upper tier. The divider panel 30 may be seen in plan view in FIG. 2. Divider panel 30 includes a main portion 31 which is configured for use with the two-tier, 2×3 array of cans shown in FIG. 1. Preferably, the surface area of portion 31 is approximately equal to the cross-sectional area of a horizontal section of one tier of cans.

Figure 2:
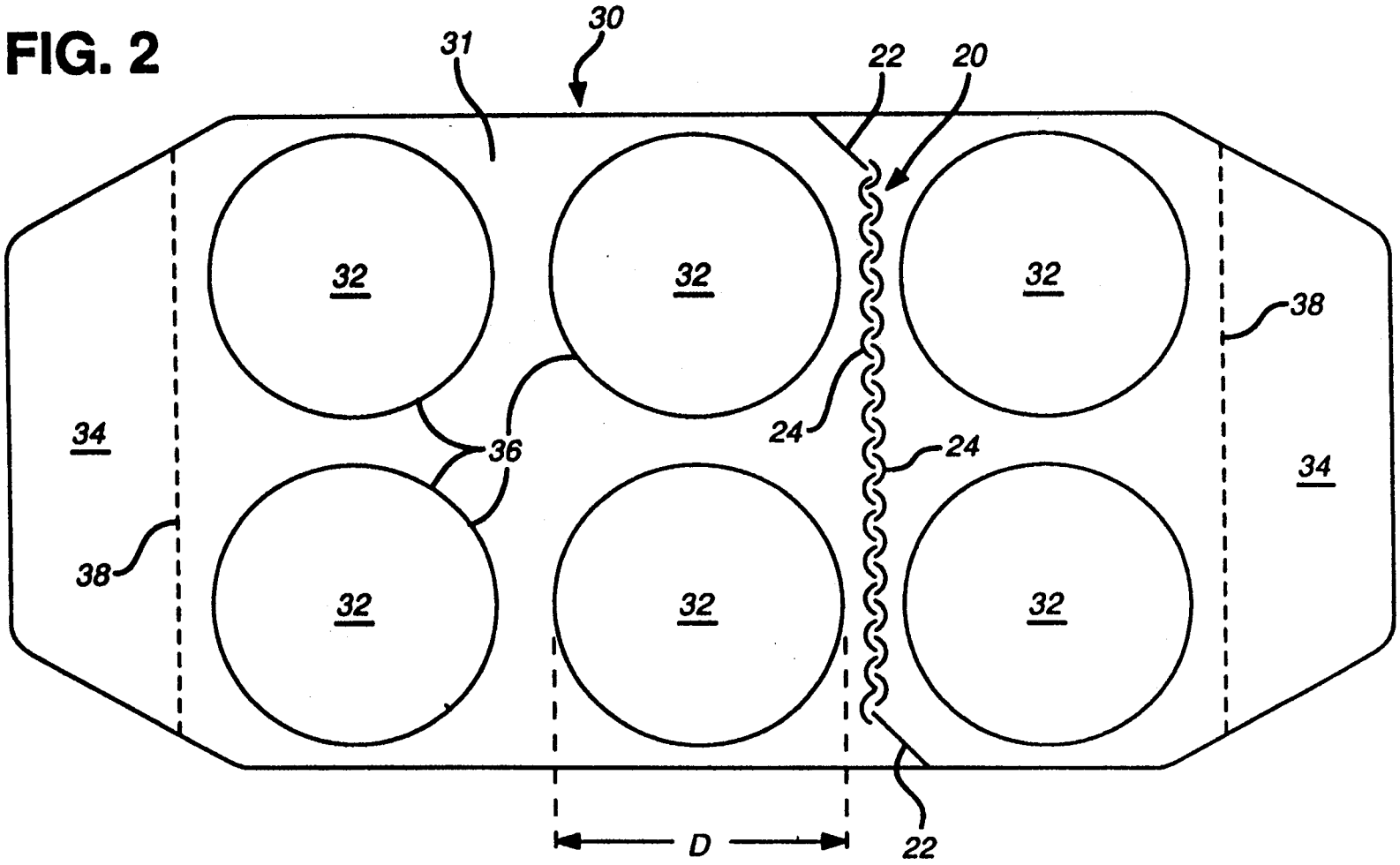
FIG. 2 is a plan view of the divider panel.

As shown in FIG. 2, panel 30 is provided at main portion 31 with a plurality of depressed areas 32 defined respectively by substantially circular debossments 36. Each area 32 is provided for a stacked pair of cans in the can arrangement. Each area 32 has a diameter D which is substantially equal to the diameter of the can flange and extends below the surface of panel portion 31 by a distance substantially equal to the distance between the upper surface of the can flange and the recessed top surface of the same can.

Depressed areas 32 are formed prior to placement of the divider panel 30 onto the lower tier of cans, preferably during its manufacture, and may be formed by known, conventional techniques. For example, the debossments may be conveniently formed using a press die machine, which is a conventional die cutting machine having a pressing die fitted thereto.

When divider panel 30 is positioned between the two tiers of cans 10, each depressed area 32 receive the adjacent lower end of an upper can, and paperboard material in each depressed area "wraps" the upper and inner surfaces of the adjacent can flange of a lower can. This is due to the fact that the diameter of depressed area 32 is generally equal to that of the can flange. Because depressed area 32 has a depth equal to the flange height, paperboard extends completely between the adjacent lower end of an upper can and upper end of a lower can, which would otherwise be in contact. This eliminates the downward compression of a solid divider panel under influence of the weight of the upper can, which would result in a disadvantageous "shrinking" of the height of a completed can arrangement.

It should be recognized that while the debossed divider panel, i.e., divider panel 30 with depressed areas 32, is used in the foregoing embodiment, an undebossed panel, i.e., a divider panel having no debossment, may be adequate for this invention. Alternatively, more than one concentric circular debossments may be provided for each depressed area for a stacked pair of cans. In fact, any type of known can-end receiving means designed for divider panels may replace the depressed area of the foregoing embodiment. For instance, an aperture may be formed at the center of each depressed area as suggested in U.S. patent application Ser. No. 08/049,787, which is hereby incorporated by reference. Alternatively, star-burst holes may be used in place of depressed areas 32 as taught in U.S. patent application Ser. No. 07/966,891, which is hereby also incorporated by reference. What is important when receiving means is employed is that the depression created in divider panel 30 by the receiving means equals the height of the can flange. This permits the paperboard to be effectively completely "sandwiched" between the stacked cans, even when the cans and divider panel are first arranged in stacked condition. The exact number of debossments necessary, of course, will depend on factors such as flange height, paperboard flexibility and the like.

Figure 1:
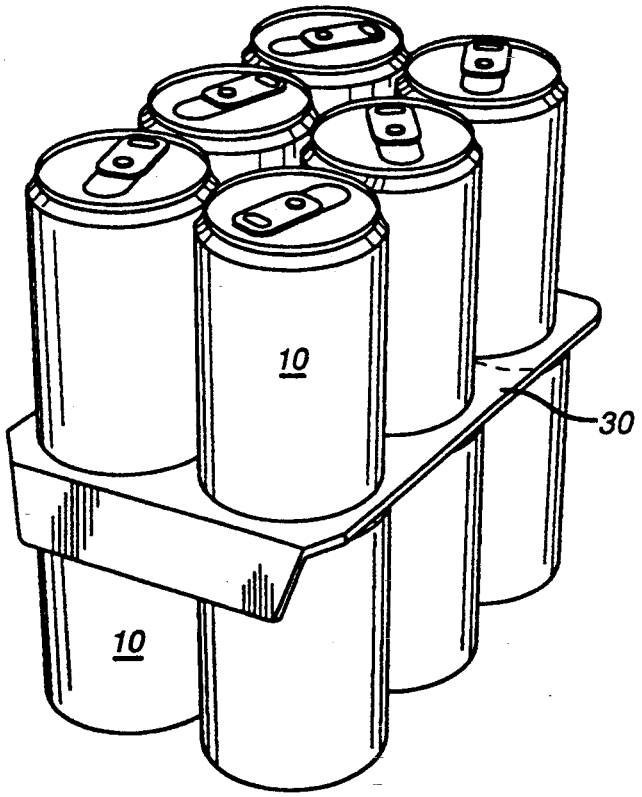
FIG. 1 is a perspective view of a two-tier arrangement of cans for placement within a carton in accordance with the present invention, showing the divider panel positioned between the tiers.

As further shown in FIG. 2, a pair of anchor flaps 34 are foldably joined to the opposite end edges of main portion 31 along fold lines 38. Preferably, these flaps 34 are somewhat smaller in length along fold line 38 than main portion 31. These anchor flaps function to structurally strengthen a completed package as well as to anchor divider panel 30 during assembly of a multi-tiered can arrangement such as shown in FIG. 1, which will be described later in more detail. A transverse tear line 20 is formed in main portion 31 so as to extend all the way across main portion 31. Tear line 20 includes a pair of oblique slits 22 extending inwardly from the side edges of portion 31 and a series of spaced arcuate slits 24 disposed interposed between slits 22. Oblique slits 22 provide pointed pull tabs which are convenient to hold with fingers.

It should be appreciated that while tear line 20 extends entirely across the divider panel, a tear line extending from one of the side edges of main portion 31 and terminating at an intermediate point between the side edges may be sufficient. Alternatively, a tear line extending diagonally of main portion 31 or routed across one or more depressed areas 32 may be used. Alternatively, any one of all the above-mentioned tear lines may be replaced by a known tear strip according to the invention. What is important is that such a tear line when being cut provide easy access to the cans in the lower tier as will be described later in detail.

Figure 3:
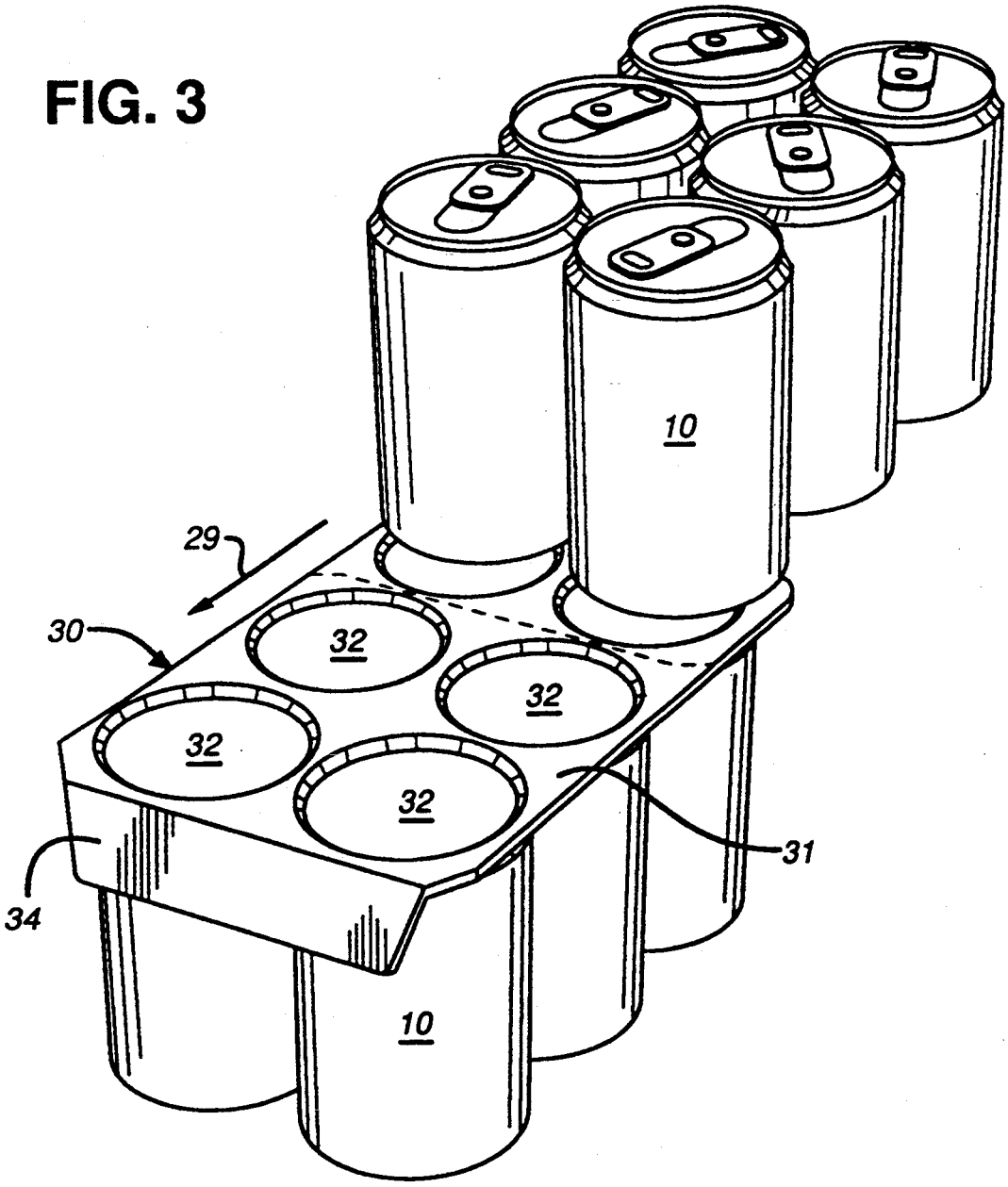
FIG. 3 is a perspective view of the cans, showing the process of preparing the two-tier arrangement in FIG. 1.

To assemble the can arrangement shown in FIG. 1, the following steps are carried out. First, divider panel 30 is placed on top of a lower tier of cans 10 which has already been arranged in 2×3 arrays. The position of panel 30 is adjusted so that each depressed area 32 is aligned with the respective pair of stacked cans. Anchor flaps 34 are then folded down along fold lines 38 so as to be disposed at a right angle with respect to main portion 31. This condition is best shown in FIG. 3 where flaps 34 (only one is shown) are positioned alongside the end pairs of cans 10 in the lower tier. After the flaps are folded, an upper tier of cans 10 which has already been arranged in 2×3 arrays is slidingly moved over the divider panel as illustrated by an arrow 29. As the upper tier of cans is moved, divider panel 30 which is in contact with the upper tier is frictionally forced to be displaced in the direction of arrow 29. However, one of anchor flaps 34, i.e., the one not shown in FIG. 3, engages the lower tier of cans and thereby prevents divider panel 30 from moving out of alignment with cans 10. As a result of the foregoing steps, the two-tier can arrangement in FIG. 1 is prepared.

The can arrangement and the divider panel thus prepared are placed into the interior of a sleeve-type carton to complete the package. The carton useful in the invention may be an otherwise conventional carton used in the packaging of beverage cans.

Figure 4:
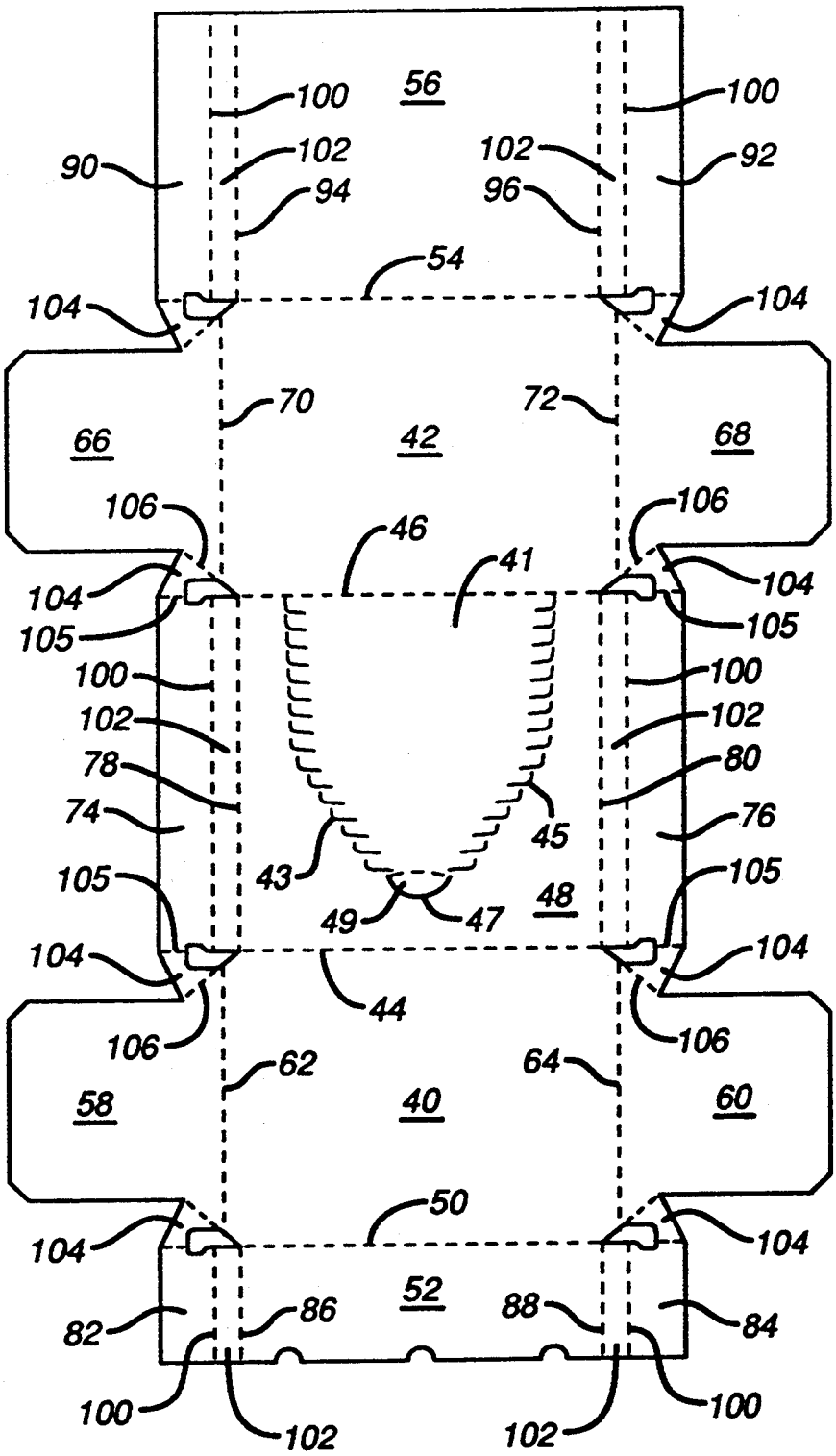
FIG. 4 is a plan view of the outer surface of a blank from which a carton in connection with the present invention may be formed.

A blank for one such carton may be seen by reference to FIG. 4. The carton includes a bottom panel 40 and a top panel 42, each connected along fold lines 44 and 46 respectively to a side panel 48. At its opposite side, bottom panel 40 is connected along fold line 50 to partial side panel 52, while top panel 42 is connected along fold line 54 to partial side panel 56.

Side panel 48 is provided with a tear open flap 41 defined by tear lines 43 and 45 formed in side panel 48. Tear lines 43 and 45 extend from fold line 46 toward fold line 44 beyond the mid point between the fold lines 44 and 46, inwardly turn toward each other, and communicate with a tear initiation slit 47 defining a pull tab 49 foldably joined to tear open flap 41. Any other types of known tear opening means can replace open flap 41. For example, the tear lines defining open flap 41 may be extended into top panel 42 so that the opening to be formed on the carton using flap 41 is enlarged. What is important: is that the tear open flap has a vertical length greater than a half of the height of the completed package so that by tear opening the open flap, at least a part of the lower tear cans is exposed. In case the number of tiers of cans in the carton is N, the vertical length L (see FIG. 8) of the tear open flap preferably exceeds $N-1$ times the height H (see FIG. 3) of a can.

Returning to FIG. 4, end closure structure, in part, is provided for the carton in the form of end flaps 58 and 60 which are foldably joined to the end edges of bottom panel 40 along fold lines 62 and 64 respectively. In addition, end flaps 66 and 68 are foldably joined to the end edges of top panel 42 along fold lines 70 and 72 respectively. End flaps 74 and 76 are foldably joined to the end edges of side panel 48 along fold lines 78 and 80 respectively. Additional end closure structure is provided in the form of partial end flaps 82 and 84 which are foldably joined to the end edges of partial side panel 52 along fold lines 86 and 88 respectively. Likewise, partial end flaps 90 and 92 are foldably joined to the end edges of partial side panel 56 along fold lines 94 and 96 respectively.

Additional fold lines 100 are formed in end flaps 74 and 76 and partial end flaps 82, 84, 90 and 92 to define bevelled corner panels 102. In addition, each end flap 74 and 76 and partial end flaps 82, 84, 90 and 92 are foldably interconnected by a web structure 104 to the adjacent one of end flaps 58, 60, 66 and 68. Each web structure 104 is defined by a fold line 105 which is substantially collinear with the fold line connecting the top or bottom panel 40 or 42 to the respective one of the side panels 48, 52 or 56. Web structure 104 is further defined by a fold line 106 which extends at an angle inwardly with respect to the corresponding one of end flaps 58, 60, 66 and 68.

Further details regarding the specific construction of the carton blank may be seen by reference to U.S. Pat. No. 4,216,861, which is hereby incorporated by reference.

Figure 5:
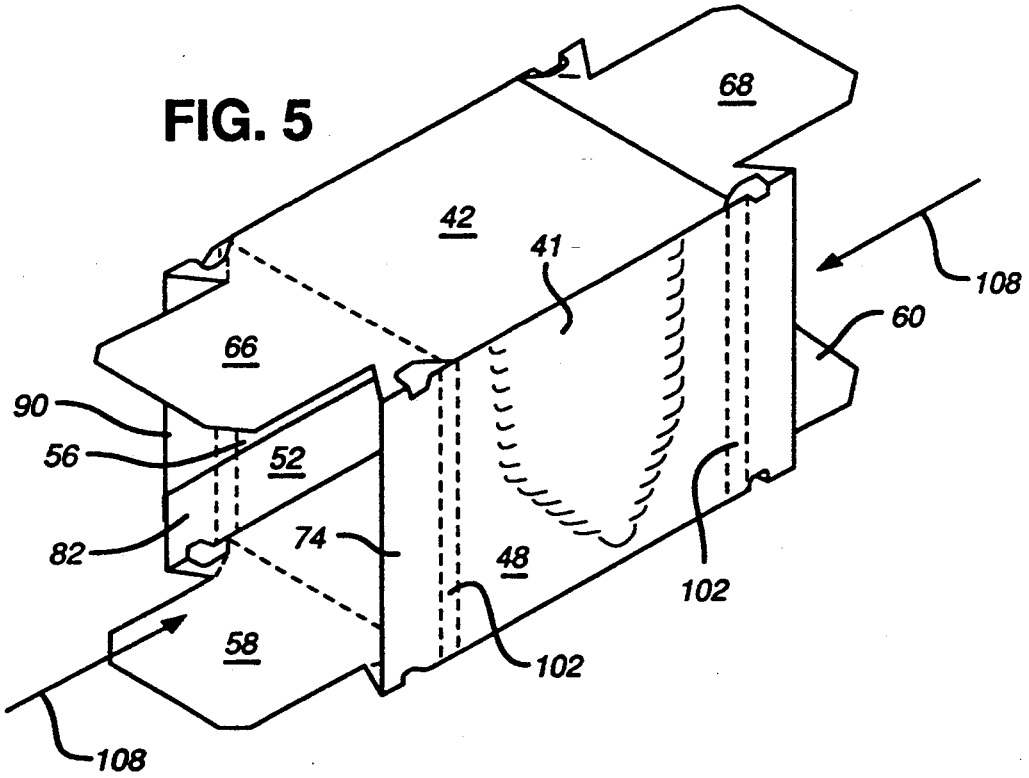
FIG. 5 is a perspective view of an erected sleeve formed from the blank of FIG. 4.
Figure 6:
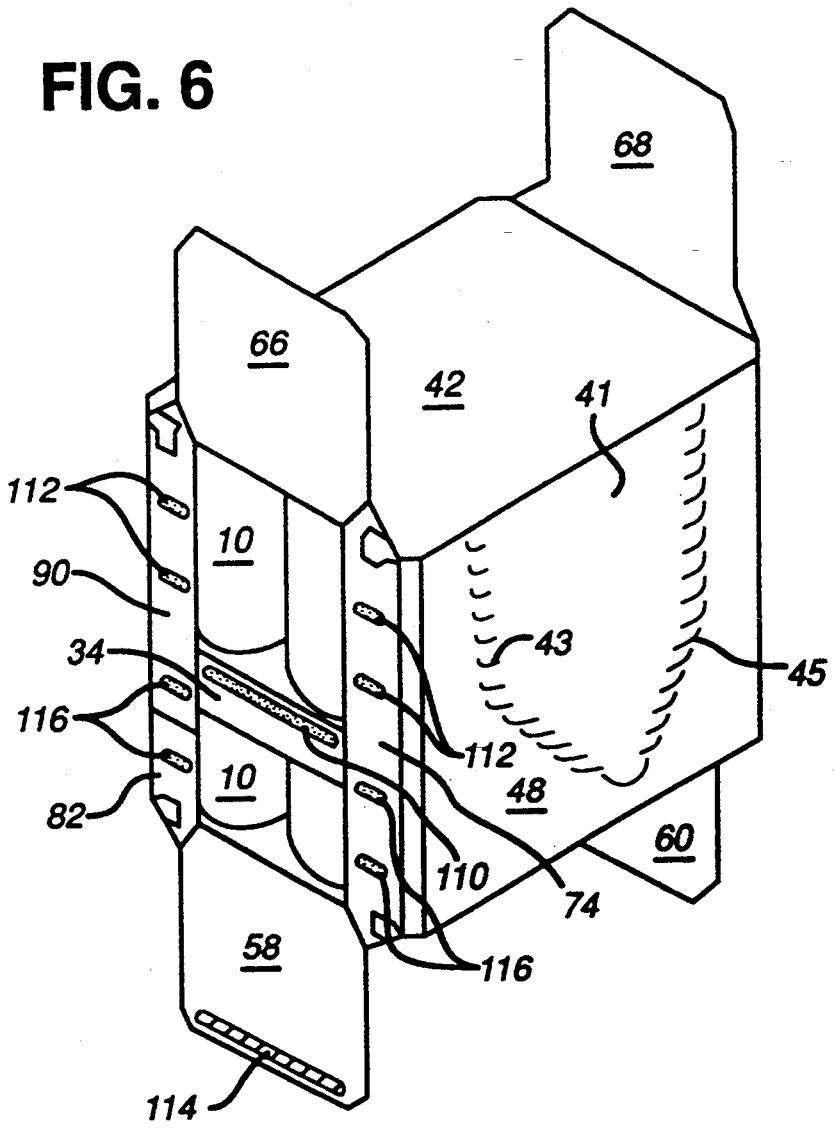
FIG. 6 is a perspective view of the erected sleeve loaded with the can arrangement of FIG. 1, showing the open ends of the sleeve partially closed.
Figure 7:
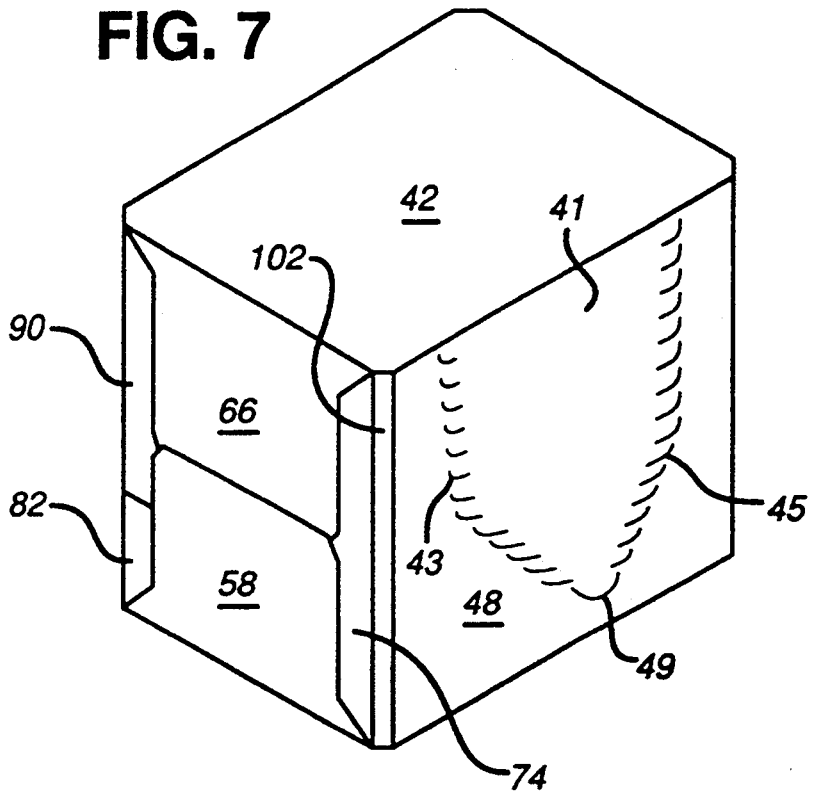
FIG. 7 is a perspective view of a completed package in accordance with the present invention.

The carton blank of FIG. 4 may be erected into a tube as shown in FIG. 5 by gluing the partial side panels 52 and 56 together to form a completed side panel. The tubular carton, as shown in FIG. 5, may then be loaded with the can arrangement and divider panel 30 through one or both of its ends as illustrated by arrows 108. The tubular carton is loaded such that anchor flaps 34 of divider panel 30 are exposed through the open ends of the tubular carton. After the can arrangement and panel 30 are received in the carton, end flaps 74 and 76 and partial end flaps 82, 84, 90 and 92 are folded inwardly of the carton to be disposed at a right angle with respect to the axis the tubular carton. This can be automatically done by folding end flaps 58, 60, 66 and 68 outwardly of the carton as illustrated in FIG. 6. After that, lines 110 and 112 of any suitable adhesive are applied to flaps 34 and the end flaps 74, 76, 90 and 92, and then end flaps. 66 and 68 are folded downward to the closed positions. By this means, end flap 66 is secured to adjacent anchor flap 34 and end flaps 74 and 90 whereas end flap 68 is secured to adjacent anchor flap 34 and end flaps 76 and 92. Subsequently, lines 114 and 116 of any suitable adhesive are applied to end flaps 74, 76, 82, 84, 90 and 92 and the inside surface of end flaps 58 and 60. End flaps 58 and 60 are then folded upward to the closed positions. This causes end flap 58 to be secured to end flaps 66, 74, 82, and 90 while causing end flap 60 to be secured to end flaps 68, 76, 84 and 92. As a result, the completed package shown in FIG. 7 is produced. Further details regarding the folding sequence of the end flaps of the carton may be found by reference to the aforementioned U.S. Pat. No. 4,216,861.

The completed package in FIG. 7 is structurally stable and rigid in that it is resistant to crushing force acting diagonally of the package and is not easily skewed when undergoing such force. This owes to the fact that the end flaps 58, 60, 66 and 68 are secured, directly or indirectly, to anchor flaps 34 of divider panel which is firmly clamped between the tiers of cans 10. In other words, rigidity of the package does not rely much upon the glue joint between adjacent end flaps such as end flaps 66 and 90, end flaps 58 and 74 and the like. This means that end flaps of a reduced size such as end flaps 74, 76, 82, 84, 90 and 92 may be sufficient. Such small end flaps allow the carton blanks to be horizontally arranged in a nested relationship and are thereby helpful in increasing the number of carton blanks taken from paperboard of a standard width.

Figure 8:
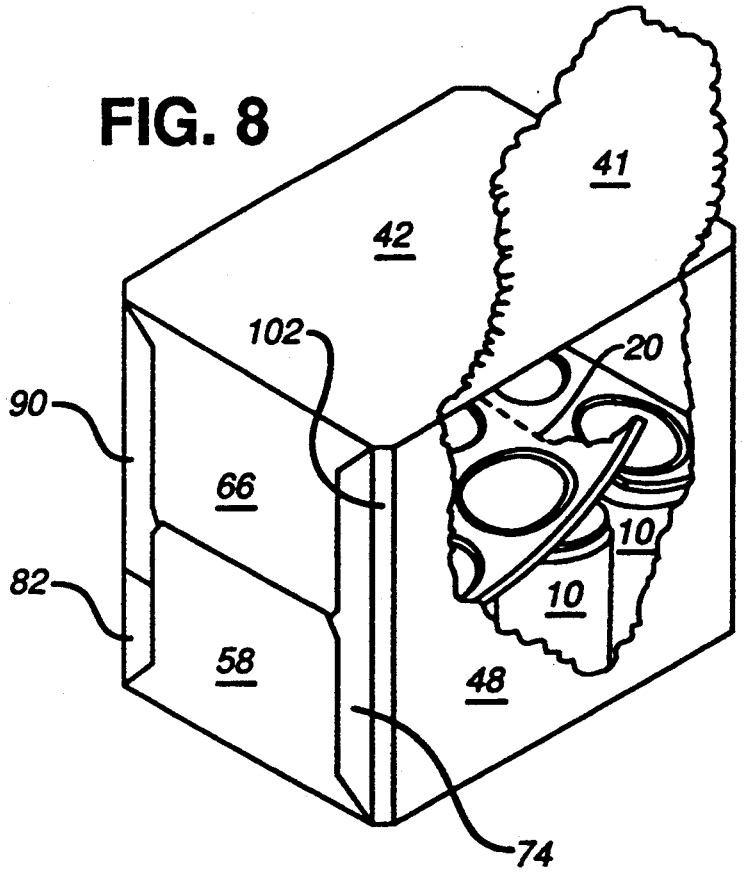
FIG. 8 is a perspective view of the package, showing an open flap of the carton is torn open.

In order to open the package of FIG. 7, side wall 48 is torn along tear lines 43 and 45, and tear open flap 41 is lifted as shown in FIG. 8. The opening formed by lifting tear open flap 41 allows cans 10 in the upper tier to be taken out of the carton therethrough. To take cans 10 in the lower tier out of the carton, divider panel 30 is torn along tear line 20 after all or most of cans 10 in the upper tier are removed from the carton. This is required because divider panel 30 is secured at the opposite ends thereof to the carton. Divider panel in the process of tearing is shown in FIG. 8.

It will be recognized that many variations may be made to the foregoing within the scope of the present invention. For example, alternate carton styles may be used, such as those having square corners rather than the bevelled corners as shown herein. Further, the carton design may be enhanced through the addition of handles, other tear opening features and the like, using structures known and understood within the art.

It should be further recognized that it would be possible to replace the single divider panel 30 with two or more divider panels, each being positioned between portions of the stacked can arrangement. This approach may be particularly useful where higher multiples of cans are desired to be placed within the carton, and/or where loading of the carton from both of its open ends is desired. Such an approach is possible by securing the respective anchor flaps of multiple divider panels together during the loading process of the carton. For example, one of two separate can arrangements may be applied at one of its anchor flaps with adhesive, and then the two can arrangements may be loaded into a carton through the opposite open ends thereof while the flap with the adhesive faces inwardly of the carton. This adhesively interconnects the respective divider panels of the can arrangement when the loading is completed.

It should be further recognized that while only one end flap, i.e., flap 66 or 68, is directly secured to the adjacent anchor flap at each end of the carton in the foregoing, it may be that both the upper and lower end flaps or even all the end flaps at each end of the carton are directly secured to the adjacent anchor flap. Alternatively, lines of adhesive 112 and 116 may be omitted.

In addition, it should be readily appreciated that instead of the lines of adhesive, any mechanical locks known in this art may be used for the purpose of securing a divider panel(s) to an outer carton according to the invention.

Figure 9:
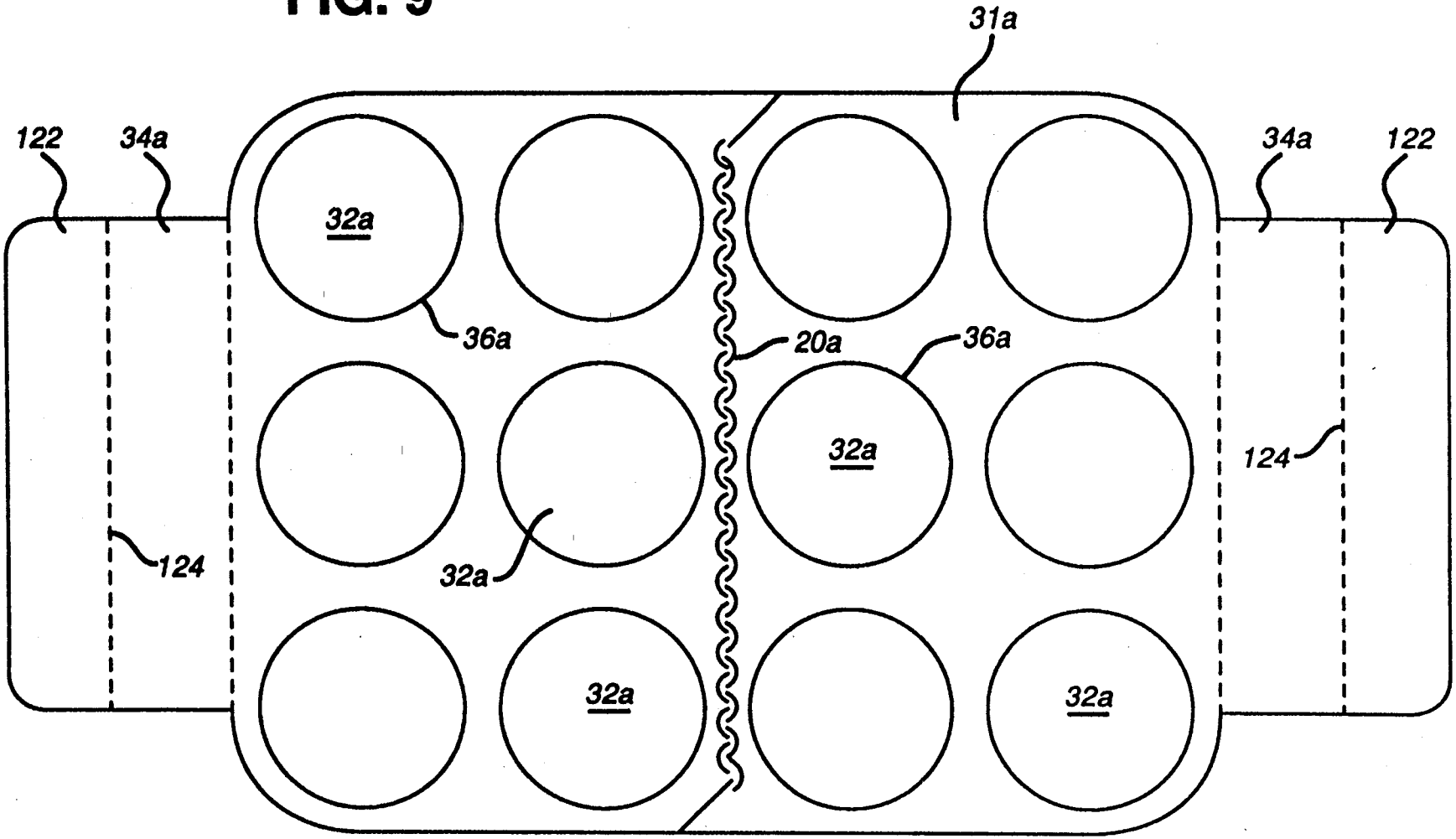
FIG. 9 is a plan view of a modified form of the divider panel in FIG. 2.

Other modifications may be made in the foregoing without departing from the scope and spirit of the claimed invention. For example, FIG. 9 illustrates a modified form of divider panel 30. The modified panel 30*a* includes a main portion 31*a* which is configured for use with two-tier, 3×4 array of cans. The notable feature of this divider panel is that it is provided with a removable tab 122 joined along a tear line 124 to the free end of at least one anchor flap 34*a*. This or these removable tabs are preferably used as removable coupon; however, they may be used for other purposes as desired. The other parts of divider panel 30*a* are similar to divider panel 30 and thus they are designated by the same numerals with the letter "a".

What is claimed is:

1. A package comprising:

a plurality of beverage cans arranged into a group of at least two vertically-aligned tiers, each of said cans having a generally cylindrical side wall defining a cylindrical axis, said cans in each of said tiers having said axes thereof disposed vertically and parallel to each other;

a carton disposed around the exterior of said group of said cans and including top and bottom panels interconnected by a pair of side panels to form a tubular structure defining a tubular axis, and a pair of end closure structures disposed to close opposite open ends of said tubular structure, said end closure structures being disposed substantially adjacent said side walls of said cans of said group along opposite ends of said group, each of said end closure structures including upper and lower end flaps foldably joined respectively to said top and bottom panels and disposed at a substantially right angle with respect to said tubular axis;

a divider panel disposed to be clamped between upper and lower adjacent ones of said tiers and in contact with said cans in said upper and lower adjacent tiers; and means for adhesively securing said divider panel to said end closure structures, said securing means comprising a pair of anchor flaps foldably joined respectively to opposite end edges of said divider panel, said anchor flaps being disposed substantially adjacent respectively to said end closure structures, each of said anchor flaps being adhesively secured to an inside surface of at least one of said upper and lower end flaps of adjacent one of said end closure structures.

2. A package according to claim 1, wherein said each end closure structure further comprises a pair of side end flaps foldably joined respectively to said side panels of said carton, said upper and lower end flaps of said each end closure structure are of a first length along said tubular axis when disposed parallel to said tubular axis, said side end flaps of said each end closure structure are of a second length along said tubular axis when disposed parallel to said tubular axis, and said first length is substantially greater than said second length.

3. A package comprising:

a plurality of beverage cans arranged into a group of at least two vertically-aligned tiers, each of said cans having a generally cylindrical side wall defining a cylindrical axis, said cans in each of said tiers having said axes thereof disposed vertically and parallel to each other;

a carton disposed around the exterior of said group of said cans and including top and bottom panels interconnected by a pair of side panels to form a tubular structure, and a pair of end closure structures disposed to close opposite open ends of said tubular structure, said end closure structures being connected to said tubular structure and being disposed substantially adjacent said side walls of said cans of said group along opposite ends of said group;

a divider panel disposed to be clamped between upper and lower adjacent ones of said tiers and in contact with said cans said upper and lower adjacent tiers; and means for adhesively securing said divider panel to said end closure structures, wherein said divider panel has tearing means for splitting said divider panel into two portions.

4. A package according to claim 3 wherein said tearing means comprises a tear line formed in said divider panel.

5. A package according to claim 3, wherein said tearing means comprises a tear strip defined by a pair of parallel tear lines formed in said divider panel.

6. A package comprising:

a plurality of beverage cans arranged into a group of at least two vertically-aligned tiers, each of said cans having a generally cylindrical side wall defining a cylindrical axis, said cans in each of said tiers having said axes thereof disposed vertically and parallel to each other;

a carton disposed around the exterior of said group of said cans and including top and bottom panels interconnected by a pair of side panels to form a tubular structure, and a pair of end closure structures disposed to close opposite open ends of said tubular structure, said end closure structures being connected to said tubular structure and being disposed substantially adjacent said side walls of said cans of said group along opposite ends of said group;

a divider panel disposed to be clamped between upper and lower adjacent ones of said tiers and in contact with said cans in said upper and lower adjacent tiers; and means for adhesively securing said divider panel to said end closure structures, wherein said each can has a height along said cylindrical axis, said side panels of said carton are disposed substantially adjacent said side walls of said cans of said group along opposite sides of said group, at least one of said side panels of said carton includes tear open means for forming an opening to allow access to said cans in said carton, and said opening has a vertical length greater than N−1 times said height of said each can provided that N is the number of said tiers.

7. A package according to claim 1, wherein said cans in one of said upper and lower adjacent tiers are coaxially aligned respectively with said cans in the other one of said upper and lower adjacent tiers, said each can has upper and lower ends, said upper end of said each can is greater in diameter than said lower end of said each can, said divider panel has a plurality of receiving means for receiving said lower ends of said cans in upper one of said adjacent tiers, each of said receiving means is defined by a generally circular edge concentric with said cylindrical axis of upper and lower coaxially aligned ones of said cans, and said circular edge is generally equal in diameter to said upper end of said each can.

8. A package according to claim 7, wherein said circular edge of said each receiving means comprises a substantially circular debossment defining a depressed area extending toward adjacent one of said cans in lower one of said adjacent tiers.

9. A package comprising:

a plurality of beverage cans arranged into a group of at least two vertically-aligned tiers;

a carton disposed around the exterior of said group of said cans;

a divider panel disposed between upper and lower adjacent ones of said tiers;

securing means for securing said divider panel to an inside surface of said carton;

tear open means for forming an opening in said carton to allow access to said cans in said upper tier; and tearing means for tearing said divider panel so as to allow access to said cans in said lower tier when some of said cans in said upper tier are removed from said carton through said opening.

10. A package according to claim 9, wherein said tearing means comprises a tear line formed in said divider panel.

11. A package according to claim 9, wherein said tearing means comprises a tear strip defined by a pair of parallel tear lines formed in said divider panel.

12. A package according to claim 9, wherein each of said cans has a generally cylindrical side wall defining a cylindrical axis, said cans in each of said tiers having said axes thereof disposed vertically and parallel to each other, and said carton includes top and bottom panels interconnected by a pair of side panels to form a tubular structure.

13. A package according to claim 12, wherein said each can has a height along said cylindrical axis, said side panels of said carton are disposed substantially adjacent said side walls of said cans of said group along opposite sides of said group, at least one of said side panels of said carton includes said tear open means for forming said opening in said at least one side panel, and said opening has a vertical length defined by the following formula:

$$L>(N-1)\,H$$

where L is said vertical length of said opening, N is the number of said tiers and H is said height of said each can.

14. A package according to claim 12, wherein said carton further includes a pair of end closure structures disposed to close opposite open ends of said tubular structure, said end closure structures being connected to said tubular structure and being disposed substantially adjacent said side walls of said cans of said group along opposite ends of said group, said securing means comprises a pair of anchor flaps joined to said divider panel and adhesively secured to said end closure structures, said tubular structure defines a tube axis, and said tearing means comprises a tear line formed in said divider panel and extending transversely of said tube axis.

* * * * *